US009352439B2

(12) United States Patent
Hong

(10) Patent No.: US 9,352,439 B2
(45) Date of Patent: May 31, 2016

(54) APPARATUS FOR GRINDING SUBSTRATE

(71) Applicant: SAMSUNG DISPLAY CO., LTD., Yongin, Gyeonggi-do (KR)

(72) Inventor: Dae Sik Hong, Cheonan-si (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 58 days.

(21) Appl. No.: 14/069,187

(22) Filed: Oct. 31, 2013

(65) Prior Publication Data

US 2015/0004883 A1 Jan. 1, 2015

(30) Foreign Application Priority Data

Jun. 28, 2013 (KR) ..... 10-2013-0075688

(51) Int. Cl.

| | |
|---|---|
| ***B24B 13/00*** | (2006.01) |
| ***B24B 13/005*** | (2006.01) |
| ***B24B 13/015*** | (2006.01) |
| ***B24B 19/00*** | (2006.01) |
| ***B24B 27/00*** | (2006.01) |
| ***B24B 29/00*** | (2006.01) |
| ***B24B 41/06*** | (2012.01) |
| ***B24D 13/10*** | (2006.01) |

(52) U.S. Cl.

CPC ..... *B24B 13/0031* (2013.01); *B24B 13/005* (2013.01); *B24B 13/015* (2013.01); *B24B 19/009* (2013.01); *B24B 27/0023* (2013.01); *B24B 27/0069* (2013.01); *B24B 27/0076* (2013.01); *B24B 29/005* (2013.01); *B24B 41/068* (2013.01); *B24D 13/10* (2013.01)

(58) Field of Classification Search

CPC B24B 9/102; B24B 27/0023; B24B 27/0069; B24B 27/0076; B24B 29/005; B24B 29/02; B24B 41/06; B24B 13/0031; B24B 13/005; B24B 13/015; B24B 19/009; B24D 13/10

USPC ..... 451/65, 66, 73, 178, 184, 231, 336, 913

See application file for complete search history.

(56) References Cited

U.S. PATENT DOCUMENTS

| | | | | |
|---|---|---|---|---|
| 2,948,087 | A * | 8/1960 | Caton | 451/271 |
| 3,550,320 | A * | 12/1970 | Kenyon et al. | 451/65 |
| 3,866,359 | A * | 2/1975 | Kikuchi | 451/271 |
| 4,078,905 | A * | 3/1978 | Oya | 451/57 |
| 6,086,461 | A * | 7/2000 | Williams et al. | 451/65 |
| 6,986,703 | B2 * | 1/2006 | Weber | 451/285 |
| 7,351,130 | B1 * | 4/2008 | Chang | 451/11 |
| 7,500,905 | B2 * | 3/2009 | Iga | 451/57 |
| 7,503,832 | B1 * | 3/2009 | Chang | 451/11 |
| 7,632,171 | B2 * | 12/2009 | Heesemann | 451/66 |
| 2012/0196515 | A1 | 8/2012 | Katayama et al. | |

FOREIGN PATENT DOCUMENTS

| | | | |
|---|---|---|---|
| KR | 10-2006-0129848 | A | 12/2006 |
| KR | 10-1246240 | B1 | 3/2013 |

* cited by examiner

*Primary Examiner* — Timothy V Eley

(74) *Attorney, Agent, or Firm* — Knobbe, Martens, Olson & Bear, LLP

(57) ABSTRACT

An apparatus for grinding a substrate is disclosed. In one aspect, the apparatus includes an inlet which receives a jig seated with a substrate including a curved surface, a grinding part grinding the substrate conveyed from the inlet, and a washing part washing the substrate conveyed from the grinding part. The grinding part includes a plurality of rollers, and each roller includes a concave portion and a convex portion which are adjacently disposed and a plurality of brushes.

20 Claims, 8 Drawing Sheets

APPARATUS FOR GRINDING SUBSTRATE

CROSS-REFERENCE TO RELATED APPLICATIONS

This application claims priority to and the benefit of Korean Patent Application No. 10-2013-0075688 filed in the Korean Intellectual Property Office on Jun. 28, 2013, the entire contents of which are incorporated herein by reference.

BACKGROUND

1. Field

The described technology generally relates to an apparatus for grinding a substrate, and more particularly, to an apparatus for grinding a substrate including a curved surface.

2. Description of the Related Technology

Displays used in mobile devices are generally formed of an acryl resin which is inexpensive and can be easily prepared. However, as mobile devices including touch screen functionality are increasingly becoming more common, synthetic resin materials, such as acryl, can have a negative impact on the use of the mobile devices such as vulnerability to scratching (strength problem), vulnerability to heat, low transmittance, high power consumption when maintaining luminance, and the like. Therefore, mobile devices generally include a glass substrate made of tempered glass for the touch panel of the device.

SUMMARY OF CERTAIN INVENTIVE ASPECTS

One inventive aspect is an apparatus for grinding a substrate for grinding a curved surface of the substrate.

Another aspect is an apparatus for grinding a substrate, including an inlet through which a jig seated with a substrate including a curved surface is received, a grinding part grinding the substrate received from the inlet, and a washing part washing the substrate received from the grinding part, wherein the grinding part includes a plurality of rollers, each roller includes a concave portion and a convex portion which are adjacently disposed, and a plurality of brushes are disposed in each roller.

The rollers may be disposed over an area in which the substrate is ground.

The rollers may each rotate in a first direction and a second direction opposite to the first direction and the rollers rotating in the first direction and the rollers rotating in the second direction may be alternately disposed.

The jig may include concave and convex portions in which the substrate is seated and the concave and convex portions of the jig may be alternately disposed.

The concave and convex portions of the rollers may respectively correspond to the convex and concave portions of the jig.

The concave portion of the jig may contact a first surface of the substrate to allow the substrate to be seated therein and the convex portion of the jig may contact a second surface which is opposite to the first surface of the substrate to allow the substrate to be seated therein.

The second surface of the substrate may be exposed when the substrate is seated in the concave portion of the jig and the first surface of the substrate may be exposed when the substrate is seated in the convex portion of the jig.

The brushes disposed in the convex portion of the rollers may contact the second surface of the substrate and the brushes disposed in the concave portion of the rollers may contact the first surface of the substrate.

The brushes may have a lattice shape.

The diameter of each the brushes may be in the range of about 0.1 mm to about 0.5 mm.

The grinding part may include an abrasive sprayer which sprays an abrasive between the brush and the substrate.

The apparatus for grinding a substrate may further include an inspection part determining whether the substrate received from the washing part includes a defect and an arrangement part arranging the substrate received from the inspection part.

Another aspect is a grinding apparatus for grinding a curved surface for a display device, the apparatus comprising: a jig configured to receive a substrate including a curved surface; and a plurality of rollers each comprising at least one concave portion and at least one convex portion which are adjacent to each other and a plurality of brushes, wherein the rollers are configured to receive the jig and grind the curved surface of the substrate.

In the above apparatus, the rollers comprise first and second rollers, wherein each of the first rollers is configured to rotate in a first direction and each of the second rollers is configured to rotate in a second direction opposite to the first direction, and wherein the first and second rollers are alternately placed. In the above apparatus, the concave and convex portions of the rollers respectively correspond to the convex and concave portions of the jig.

In the above apparatus, the substrate comprises first and second curved surfaces opposite to each other and wherein the concave and convex portions of the jig are configured to respectively contact the first and second curved surfaces to allow the substrate to be seated thereon. In the above apparatus, the brushes disposed in the convex portion of the rollers are configured to contact the second curved surface of the substrate and wherein the brushes disposed in the concave portion of the roller are configured to contact the first curved surface of the substrate.

In the above apparatus, the brushes have a lattice shape. In the above apparatus, the diameter of each brush is in the range of about 0.1 mm to about 0.5 mm. The above apparatus further comprises an abrasive sprayer configured to spray an abrasive between the brushes and the substrate.

According to at least one embodiment, the apparatus for grinding a substrate can substantially simultaneously grind both of the front and rear surfaces of the substrate including the curved surface.

Additionally, according to at least one embodiment, the grinding, washing, and inspection of the substrate including the curved surface can be simultaneously performed, thereby reducing the processing time thereof.

DETAILED DESCRIPTION OF CERTAIN INVENTIVE EMBODIMENTS

Figure 1:
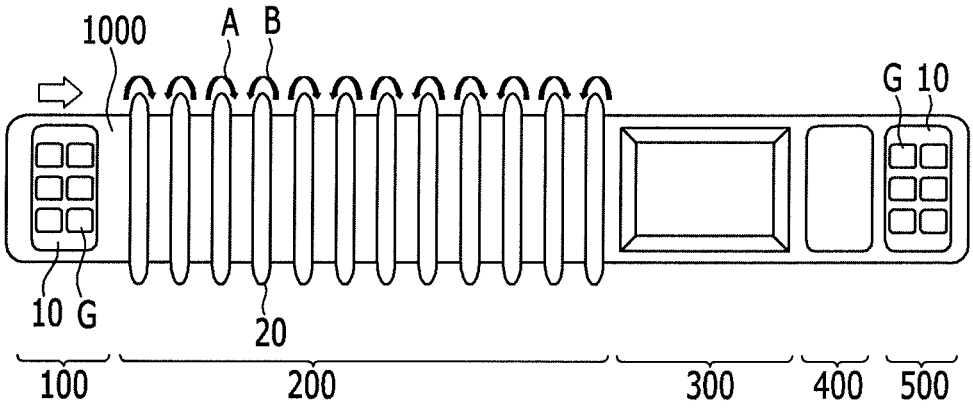
FIG. 1 is a diagram schematically illustrating an apparatus for grinding a substrate according to an exemplary embodiment.

Typically, a glass touch panel used in a mobile device has a plate shape, and the grinding of both surfaces of the glass substrate are performed using a relatively simple process. However, when the glass touch panel has a curved surface, the surface grinding may not be effectively performed. Generally, the grinding of a curved surface is manually performed on each portion on the curved surface requiring a substantial amount of processing time, thereby remarkably reducing the productivity for manufacturing a mobile device with a curved touch panel.

The described technology will be described more fully hereinafter with reference to the accompanying drawings, in which exemplary embodiments of the described technology are shown. As those skilled in the art would realize, the described embodiments may be modified in various different ways, all without departing from the spirit or scope of the described technology.

In order to clearly describe the described technology, portions that are not connected with the description will be omitted. Like reference numerals designate like elements throughout the specification.

In addition, the sizes and thicknesses of elements illustrated in the drawings may be exaggerated to facilitate understanding and ease of description, but the described technology is not limited thereto.

It will be understood that when an element such as a layer, film, region, or substrate is referred to as being "on" another element, it can be directly on the other element or intervening elements may also be present. In contrast, when an element is referred to as being "directly on" another element, there are not intervening elements present.

In addition, unless explicitly described to the contrary, the word "comprise" and variations such as "comprises" or "comprising", will be understood to imply the inclusion of stated elements but not the exclusion of any other elements. Further, in the specification, spatially relative terms such as "on" or "below" refer to the relative positioning of an element as on or below another element of the device, but is not limited to the described positioning with respect to the other element based on the orientation of the device.

Hereinafter, an apparatus for grinding a substrate according to an exemplary embodiment of the described technology will be described in detail with reference to FIG. 1.

FIG. 1 is a diagram schematically illustrating an apparatus for grinding a substrate according to an exemplary embodiment.

As illustrated in FIG. 1, the apparatus for grinding a substrate according to the exemplary embodiment grinds the surface of a substrate G formed with a curved surface once and includes an inlet 100 through which the substrate G is inserted, a grinding part 200 (hereinafter to be used interchangeably with "grinder") grinding the surface of the substrate G, and a washing part 300 (hereinafter to be used interchangeably with "washer") washing and drying the ground substrate G. Further, the apparatus for grinding a substrate includes an inspection part 400 inspecting the ground substrate G and an arrangement part 500 arranging the ground substrate G. In this configuration, the inspection part 400 and the arrangement part 500 may be separated from the inlet 100, the grinding part 200, and the washing part 300.

The substrate G is seated in the jig 10 and is sequentially conveyed from the inlet 100 to the grinding part 200, the washing part 300, the inspection part 400, and the arrangement unit 500 by a conveyor 1000.

The substrate G may be formed of glass and a central portion thereof has a curved surface. The jig 10 includes a concave portion 11 and a convex portion 12 to be described below so as to allow the curved substrate G to be seated therein.

The inlet 100 receives the substrate G seated in the jig 10 and the jig 10 is conveyed from the inlet to the remaining elements of the apparatus for grinding a substrate.

The grinding part 200 grinds the surface of the substrate G conveyed from the inlet 100 by the conveyor 1000. Dents, foreign materials, scratches, and the like, which are formed on the surface of the substrate G are removed by the grinding.

The grinding part 200 is provided with a plurality of rollers 20 which grind the surface of the substrate G seated in the jig 10. The rollers 20 each rotate in a first direction A and a second direction B opposite to the first direction A. The rollers 20 rotating in the first direction A and the rollers 20 rotating in the second direction B are alternately disposed in the conveyance direction of the substrate G.

Each roller 20 includes a convex portion 21 and a concave portion 22 to be described below. Further, each roller 20 is provided with a plurality of brushes 23 to be described below. The convex portion 21 of the rollers 20 corresponds to the concave portion 11 of the jig 10 and the concave portion 22 of the rollers 20 corresponds to the convex portion 12 of the jig 10. Each roller 20 rotates and the surface of the substrate G is ground by the plurality of brushes 23 disposed on each roller 20.

Each roller 20 is disposed over the jig 10 and the jig 10 including the substrate G are conveyed past the rollers. Each roller 20 moves substantially vertically to allow the brushes 23 to contact the substrate G so as to grind the surface of the substrate G.

The grinding part 200 may be provided with an abrasive sprayer which sprays an abrasive such as cerium oxide $CeO_2$. The abrasive may be sprayed between the brushes 23 and the substrate G when grinding the surface of the substrate G.

The washing part 300 washes and dries the substrate G conveyed from the grinding part 200 by the conveyor 1000. The washing part 300 washes and dries grinding dregs, the abrasive, and the like, generated by the grinding and remaining on the substrate G by using a cleaning agent.

The inspection part 400 inspects the substrate G conveyed from the washing part 400 by the conveyor 1000. The inspection part 400 inspects the substrate to determine whether a defect is present in the substrate G which has been ground, washed, and dried. The conveyer 1000 conveys the substrate G which has been determined to be defect free to the arrangement part 500. The substrate G which has been determined to include a defect may be ground, washed, and dried again depending on the type and severity of the defects.

The arrangement part 500 separates and arranges the substrates G conveyed from the inspection part 400 in the jig 10. After the inspection part 400 performs the inspection, the arrangement part 500 separates the defect free substrates G from the jig 10 and then arranges the substrates G to be easily conveyed to the following processes.

Next, the jig according to the present exemplary embodiment will be described in detail with reference to FIGS. 2 to 4.

Figure 2:
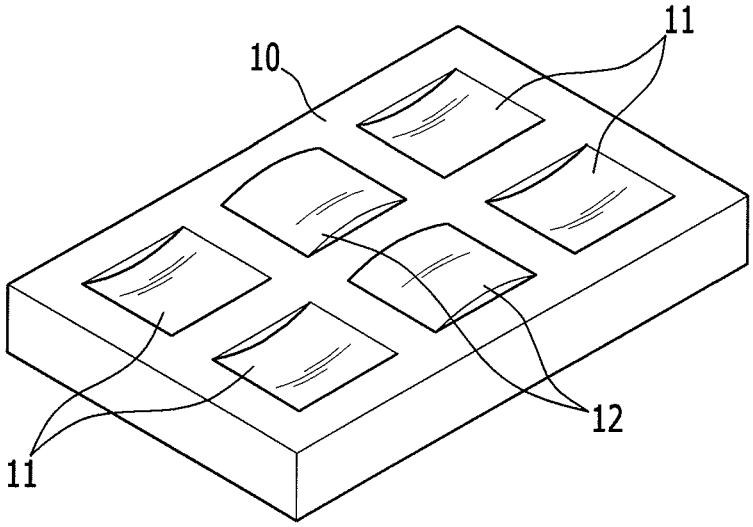
FIG. 2 is a diagram illustrating a jig according to an exemplary embodiment.
Figure 3:
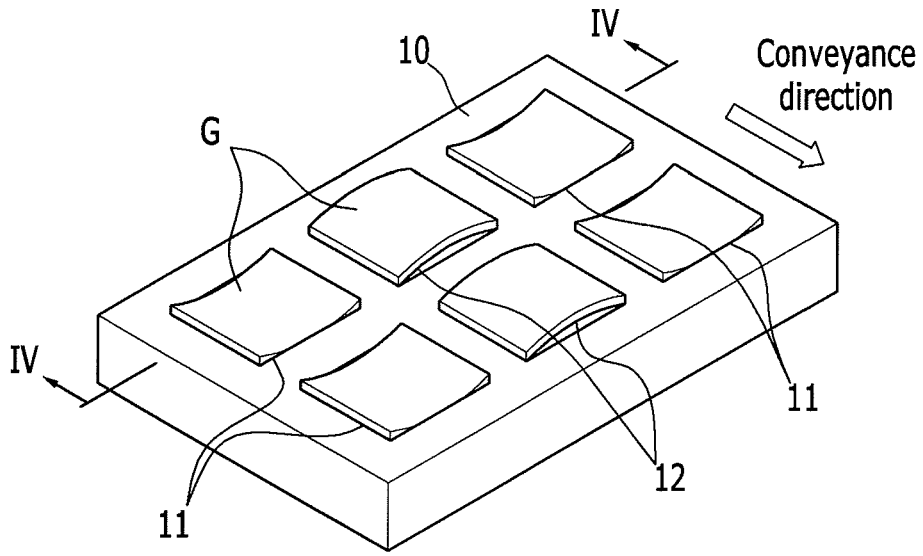
FIG. 3 is a diagram illustrating a case in which a substrate is seated in the jig according to an exemplary embodiment.
Figure 4:
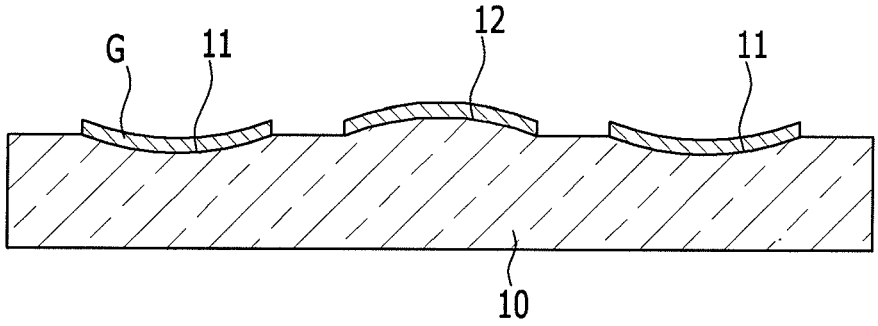
FIG. 4 is a cross-sectional view taken along line IV-IV of FIG. 3.

FIG. 2 is a diagram illustrating a jig according to an exemplary embodiment, FIG. 3 is a diagram schematically illustrating the case in which substrates G are seated in the jig according to the present exemplary embodiment, and FIG. 4 is a cross-sectional view taken along the line IV-IV of FIG. 3.

Referring to FIGS. 2 to 4, the jig 10 according to the present exemplary embodiment includes the concave and convex portions 11 and 12 which seat the curved substrates G.

The concave and convex portions 11 and 12 of the jig 10 are alternately disposed in a direction substantially perpendicular to the direction of conveyance of the jig 10. The present exemplary embodiment illustrates the case where six substrates G are seated in the jig 10, but the described technology is not limited thereto, and therefore the number of substrates G which may be seated in the jig 10 may be greater or less than six.

The concave portion 11 of the jig 10 is seated with the substrate G through contact with a first surface (hereinafter, referred to as a back surface) of the substrate G and the convex portion 12 of the jig 10 is seated with the substrate G through contact with a second surface (hereinafter, referred to as a front surface) of the substrate G which is the side of the substrate G opposite to the back surface.

That is, the front surface of the substrate G is exposed when the substrate G is seated in the concave portion 11 of the jig 10 and the back surface of the substrate G is exposed when the substrate G is seated in the convex portion 12 of the jig 10. As described above, the substrates G seated in the concave and the convex portions 11 and 12 of the jig 10 each respectively expose the front and back surfaces of the substrates G to grind the front and back surfaces of the substrates G.

Additionally, the jig 10 is formed such that the curvature radius of the substrate G may be substantially the same as that of the concave and convex portions 11 and 12 of the jig 10 to facilitate the seating of the substrates G into the concave and convex portions 11 and 12 of the jig 10.

Next, a roller according to the present exemplary embodiment will be described in detail with reference to FIGS. 5 and 6.

Figure 5:
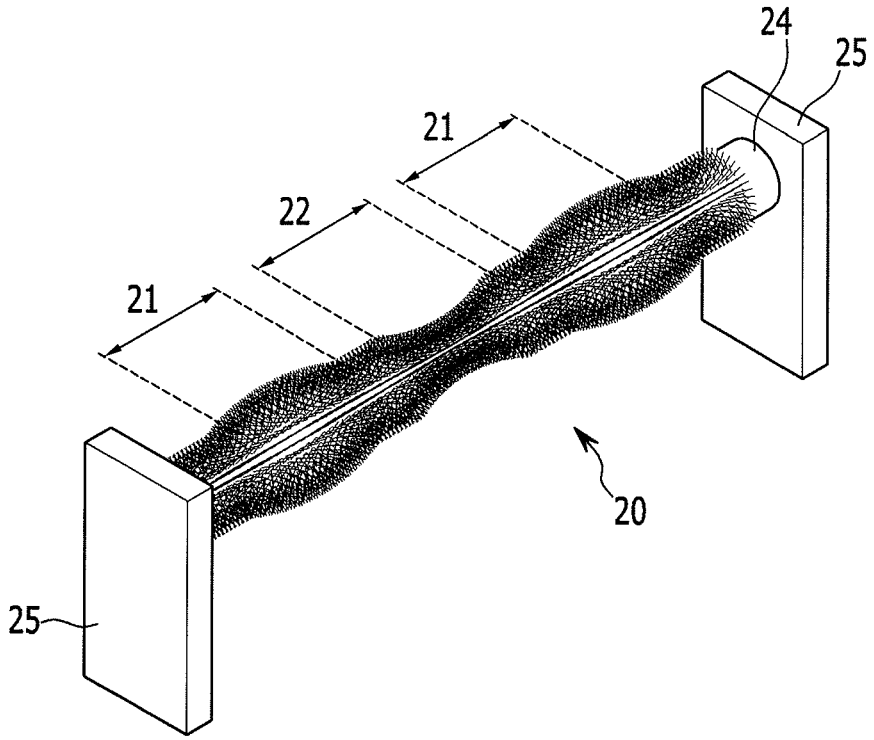
FIG. 5 is a perspective view illustrating a roller according to an exemplary embodiment.
Figure 6:
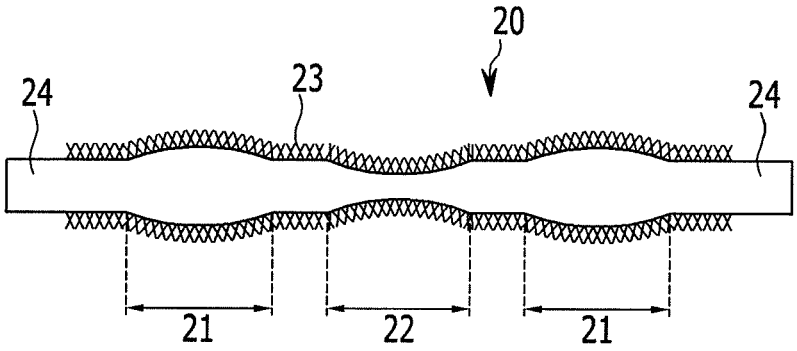
FIG. 6 is a cross-sectional view of a roller according to the exemplary embodiment.

FIG. 5 is a perspective view illustrating a roller according to an exemplary embodiment and FIG. 6 is a cross-sectional view of a roller according to the exemplary embodiment.

Referring to FIGS. 5 and 6, the roller 20 according to the present exemplary embodiment includes a convex portion 21 and a concave portion 22. The roller 20 is provided with a plurality of brushes 23 and the concave portion 22 of the roller 20 is disposed between the convex portions 21. Further, connection parts 24 are disposed at both sides of the roller 20 and are each connected to a support 25. The roller 20 may move substantially vertically with respect to the support 25.

The brushes 23 disposed on the roller 20 grind the surface of the substrate G and the diameter of the brushes 23 may be between about 0.1 mm to about 0.5 mm. When the diameter of the brushes 23 is less than about 0.1 mm, the grinding of the surface the substrate G may not be performed well and when the diameter of the brush 23 exceeds about 0.5 mm, the surface of the substrate G may be damaged. However, according to embodiments, the diameter of the brushes may be less than about 0.1 mm or greater than about 0.5 mm. Additionally, the length of the brushes 23 may be between about 6 mm to about 10 mm and the material used to form the brushes 23 may be nylon. However, according to embodiments, the length of the brushes may be less than about 6 mm or may be greater than about 10 mm.

The brushes 23 have a lattice shape. The surface of the substrate G is ground by rotating the roller 20 and when the brushes 23 have a substantially straight shape, the brushes 23 rotates only in one direction, and thus may scratch the surface of the substrate G. Therefore, the brushes 23 may be formed in a lattice shape to substantially prevent the brushes 23 from rotating in only one direction, thereby substantially preventing the scratches from occurring on the surface of the substrate G.

Next, the grinding of the substrate G using the apparatus for grinding a substrate according to an exemplary embodiment will be described in detail with reference to FIGS. 7 and 8.

Figure 7:
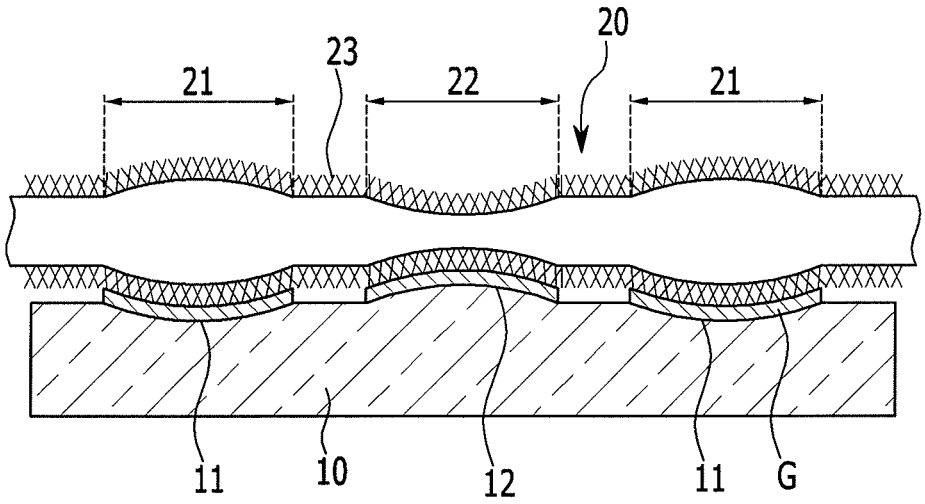
FIGS. 7 and 8 are diagrams illustrating the case in which the substrate is ground by using the roller in the apparatus for grinding a substrate according to the exemplary embodiment.
Figure 8:
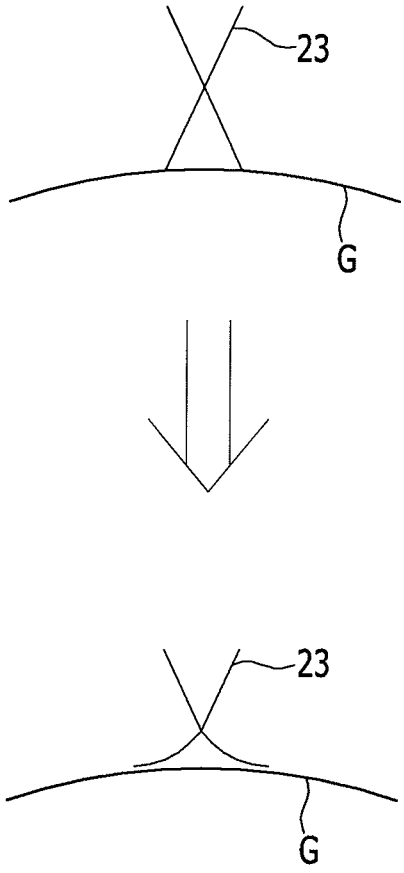

FIGS. 7 and 8 are diagrams illustrating the case in which the substrate is ground using the roller in the apparatus for grinding a substrate according to the present exemplary embodiment.

When the jig 10 in which the substrate 10 is seated is conveyed to the grinding part 200 from the inlet 100 by the conveyor 1000, the surface of the substrate G is ground by the rollers 20 of the grinding part 200.

Referring to FIGS. 7 and 8, the substrates G seated in the concave and convex portions 11 and 12 of the jig 10 contacts the brushes 23 disposed on the rollers 20 and are ground by the rotation of the rollers 20. In this case, an abrasive may be sprayed between the brushes 23 and the substrates G.

At the time of grinding the substrates G, the convex and concave portions 21 and 22 of the rollers 20 respectively correspond to the concave and convex portions 11 and 12 of the jig 10.

The concave portion 11 of the jig 10 contacts the back surface of the substrate G to seat the substrate G therein such that the front surface of the substrate G contacts the brushes 23 of the convex portion 21 of the rollers 20. The convex portion 12 of the jig 10 contacts the front surface of the substrate G to seat the substrate G therein such that the back surface of the substrate G contacts the brushes 23 of the concave portion 22 of the rollers 20. That is, the brushes 23 disposed in the convex and concave portions 21 and 22 of the rollers 20 each contact the front and back surfaces of the substrates G and the front and back surfaces of the substrates G are ground by the rotation of the rollers 20.

Moreover, the convex and concave portions 21 and 22 of the rollers 20 each correspond to the concave and convex portions 11 and 12 of the jig 10, such that the radius of curvature of the convex and concave portions 21 and 22 of the rollers 20 may be the same as that of the substrates G.

At the time of grinding the substrates G, after the end of the brushes 23 contacts the surface of the substrates G, the rollers 20 moves substantially vertically with respect to the substrate G by about 3 mm. In this case, the lower portion of the brushes 23 contacts the surface of the substrate G, thereby grinding the front and back surfaces of the substrates G.

Further, the substrates G are seated in the jig 10 and are ground while moving across the conveyor 1000. That is, the substrates G are ground while passing by the rollers 20. In this case, the conveyor 1000 should not stop for longer than about 10 seconds. When the conveyor 1000 stops for longer than about 10 seconds, that is, when the substrate G does not move for longer than about 10 seconds, since the rollers 20 continuously rotate and grind the substrates G, the surface of the substrates G may be damaged.

As described above, the apparatus for grinding a substrate includes the jig 10 seated with the substrate G including the curved surface and the jig 10 includes the concave and convex portions 11 and 12. The apparatus further includes the rollers 20 including the convex and concave portions 21 and 22. When grinding the substrate G, the convex and concave portions 21 and 22 of the rollers 20 each correspond to the concave and convex portions 11 and 12 of the jig 10 so that both of the front and rear surfaces of the curved substrates G may be simultaneously ground.

Further, the grinding, washing, and inspection of the substrate G including the curved surface can be simultaneously performed, thereby reducing the processing time.

While the described technology has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. An apparatus for grinding a substrate, comprising:

an inlet configured to receive a jig on which a substrate including a curved surface is seated;

a grinder configured to grind the substrate received from the inlet; and a washer configured to wash and dry the substrate received from the grinder, wherein the grinder includes a plurality of rollers, and wherein each roller comprises a plurality of brushes and at least one concave portion and at least one convex portion, with a flat portion interposed therebetween, the concave portion and the convex portion being horizontally adjacent to each other.

2. The apparatus of claim 1, wherein the rollers are placed er an area in which the substrate is ground.

3. The apparatus of claim 1, wherein the jig comprises concave and convex portions that are alternately formed, and wherein the concave and convex portions are configured to receive the substrate thereon.

4. The apparatus of claim 3, wherein the concave and convex portions of the rollers respectively correspond to the convex and concave portions of the jig.

5. The apparatus of claim 3, wherein the substrate comprises first and second surfaces opposite to each other and wherein the concave and convex portions of the jig are configured to respectively contact the first and second surfaces to allow the substrate to be seated thereon.

6. The apparatus of claim 5, wherein the second surface of the substrate is configured to be exposed when the substrate is seated on the concave portion of the jig and wherein the first surface of the substrate is configured to be exposed when the substrate is seated on the convex portion of the jig.

7. The apparatus of claim 5, wherein the brushes disposed in the convex portion of the rollers are configured to contact the second surface of the substrate and wherein the brushes disposed in the concave portion of the rollers are configured to contact the first surface of the substrate.

8. The apparatus of claim 1, wherein the brushes have a lattice shape.

9. The apparatus of claim 8, wherein a diameter of each brush is in the range of about 0.1 mm to about 0.5 mm.

10. The apparatus of claim 1, wherein the grinder comprises an abrasive sprayer configured to spray an abrasive between the brushes and the substrate.

11. The apparatus of claim 1, further comprising:

an inspection part configured to determine if the substrate received from the washer includes a defect; and an arrangement part configured to arrange the substrate received from the inspection part.

12. An apparatus for grinding a substrate, comprising an inlet configured to receive a jig on which a substrate including a curved surface is seated;

a grinder configured to grind the substrate received from the inlet; and a washer configured to wash and dry the substrate received from the grinder, wherein the grinder includes a plurality of rollers, and wherein each roller comprises a plurality of brushes and at least one concave portion and at least one convex portion which are adjacent to each other, wherein the rollers comprise a plurality of first rollers and a plurality of second rollers, wherein each of the first rollers is configured to rotate in a first direction and each of the second rollers is configured to rotate in a second direction opposite to the first direction, and wherein the first and second rollers are alternately placed.

13. A grinding apparatus for grinding a curved surface for a display device, the apparatus comprising:

a jig configured to receive a substrate including a curved surface; and a plurality of rollers each comprising a plurality of brushes and at least one concave portion and at least one convex portion which are adjacent, to each other, wherein the rollers are configured to receive the jig and grind the curved surface of the substrate.

14. The apparatus of claim 13, wherein the rollers comprise first and second rollers, wherein each of the first rollers is configured to rotate in a first direction and each of the second rollers is configured to rotate in a second direction opposite to the first direction, and wherein the first and second rollers are alternately placed.

15. The apparatus of claim 14, wherein the concave and convex portions of the rollers respectively correspond to the convex and concave portions of the jig.

16. The apparatus of claim 14, wherein the substrate comprises first and second curved surfaces opposite to each other and wherein the concave and convex portions of the jig are configured to respectively contact the first and second curved surfaces to allow the substrate to be seated thereon.

17. The apparatus of claim 16, wherein, the brushes disposed in the convex portion of the rollers are configured to contact the second curved surface of the substrate and wherein the brushes disposed in the concave portion of the roller are configured to contact the first curved surface of the substrate.

18. The apparatus of claim 13, wherein the brushes have a lattice shape.

19. The apparatus of claim 18, wherein a diameter of each brush is in the range of about 0.1 mm to about 0.5 mm.

20. The apparatus of claim 13, further comprising an abrasive sprayer configured to spray an abrasive between the brushes and the substrate.

* * * * *